US011286656B1

(12) United States Patent
Mesadieu

(10) Patent No.: US 11,286,656 B1
(45) Date of Patent: Mar. 29, 2022

(54) BIDET-TYPE TOILET ATTACHMENT

(71) Applicant: Chenet Mesadieu, New York, NY (US)

(72) Inventor: Chenet Mesadieu, New York, NY (US)

( * ) Notice: Subject to any disclaimer, the term of this patent is extended or adjusted under 35 U.S.C. 154(b) by 0 days.

(21) Appl. No.: 17/142,040

(22) Filed: Jan. 5, 2021

(51) Int. Cl.

| | |
|---|---|
| ***E03D 9/08*** | (2006.01) |
| ***E03D 9/00*** | (2006.01) |
| ***A47K 7/04*** | (2006.01) |
| ***A47K 7/08*** | (2006.01) |
| ***A47K 10/48*** | (2006.01) |

(52) U.S. Cl.
CPC ..... *E03D 9/08* (2013.01); *A47K 7/04* (2013.01); *A47K 7/08* (2013.01); *A47K 10/48* (2013.01); *E03D 9/005* (2013.01)

(58) Field of Classification Search
CPC .. E03D 9/08; E03D 9/005; A47K 7/04; A47K 7/08
USPC ..... 4/443
See application file for complete search history.

(56) References Cited

U.S. PATENT DOCUMENTS

| | | | | |
|---|---|---|---|---|
| 9,834,919 | B1 * | 12/2017 | Shabat | A47K 13/24 |
| 2018/0028797 | A1 * | 2/2018 | Schwab | A61M 3/022 |
| 2018/0064295 | A1 * | 3/2018 | Okada | A47K 10/34 |
| 2020/0011041 | A1 * | 1/2020 | Saeki | E03D 9/08 |
| 2020/0199860 | A1 * | 6/2020 | Giertz | E03D 9/08 |

* cited by examiner

*Primary Examiner* — Huyen D Le
(74) *Attorney, Agent, or Firm* — Lyman Moulton, Esq.; Moulton Patents, PLLC

(57) ABSTRACT

The electronic bidet toilet attachment is a device that can be installed on a regular toilet and has all the functions of a regular bidet, including water spraying, soap dispensing, blow drying, and a soft brush. Further enhancements include a motion activated light and spray enabling water sound induced urination. A perfume and cologne mister is also included. The device attaches to the toilet seat of a regular toilet, and a hook mounts a small cleaning fluid tank within the water tank of the toilet. That is the electronic bidet device's source of water and is coaxial with the fluid soap line. The electronic bidet-type toilet attachment has a side control panel for the user to conveniently operate the device. There are buttons to actuate all the aforementioned features, as well as a dial to control intensity and a button to flush the toilet.

20 Claims, 3 Drawing Sheets

BIDET-TYPE TOILET ATTACHMENT

BACKGROUND

A bidet is a bowl or receptacle designed to be sat on for the purpose of washing the human genitalia, perineum, inner buttocks, and anus. The modern variety includes a plumbed-in water supply and a drainage opening, and is thus a type of plumbing fixture subject to local hygiene regulations. The bidet is designed to promote personal hygiene, and is used after defecation, and before and after sexual intercourse. In several European countries, a bidet is today required by law to be present in every bathroom containing a toilet bowl. It was originally located in the bedroom, near the chamber-pot and the marital bed, but in modern times is located near the toilet bowl in the bathroom. Fixtures that combine a toilet seat with a washing facility include the electronic bidet. There have been no products available as original equipment or as an aftermarket to address this problem.

An electronic bidet is a seat attached to an existing toilet or a part of the toilet itself, with a nozzle to squirt a jet of warm water for cleaning the anus and female genitals, electrically powered and with electronic controls. It replaces the conventional bidet, a separate plumbing fixture not attached to a toilet. Some bidets of this type have one adjustable nozzle on the side rim for anus and genital areas, or two nozzles on the back rim, a shorter "family nozzle" for washing the area around the anus, and a longer "bidet nozzle" for women to wash their vulva. There have been no products available as original equipment or as an aftermarket to address this problem either.

There exists a need for a bidet-type toilet attachment that is not being met by any known or disclosed device or system of present.

SUMMARY OF THE INVENTION

The electronic bidet toilet attachment is a device that can be installed on a regular toilet and has all the functions of a regular bidet, including water spraying, soap dispensing, blow drying, and a soft brush. The device attaches to the toilet seat of a regular toilet, and a hook mounts a small cleaning fluid tank within the water tank of the toilet. That is the electronic bidet device's source of water. The electronic bidet-type toilet attachment has a side control panel for the user to conveniently operate the device. There are buttons to actuate all the aforementioned features, as well as a dial to control intensity and a button to flush the toilet.

Figure 1:
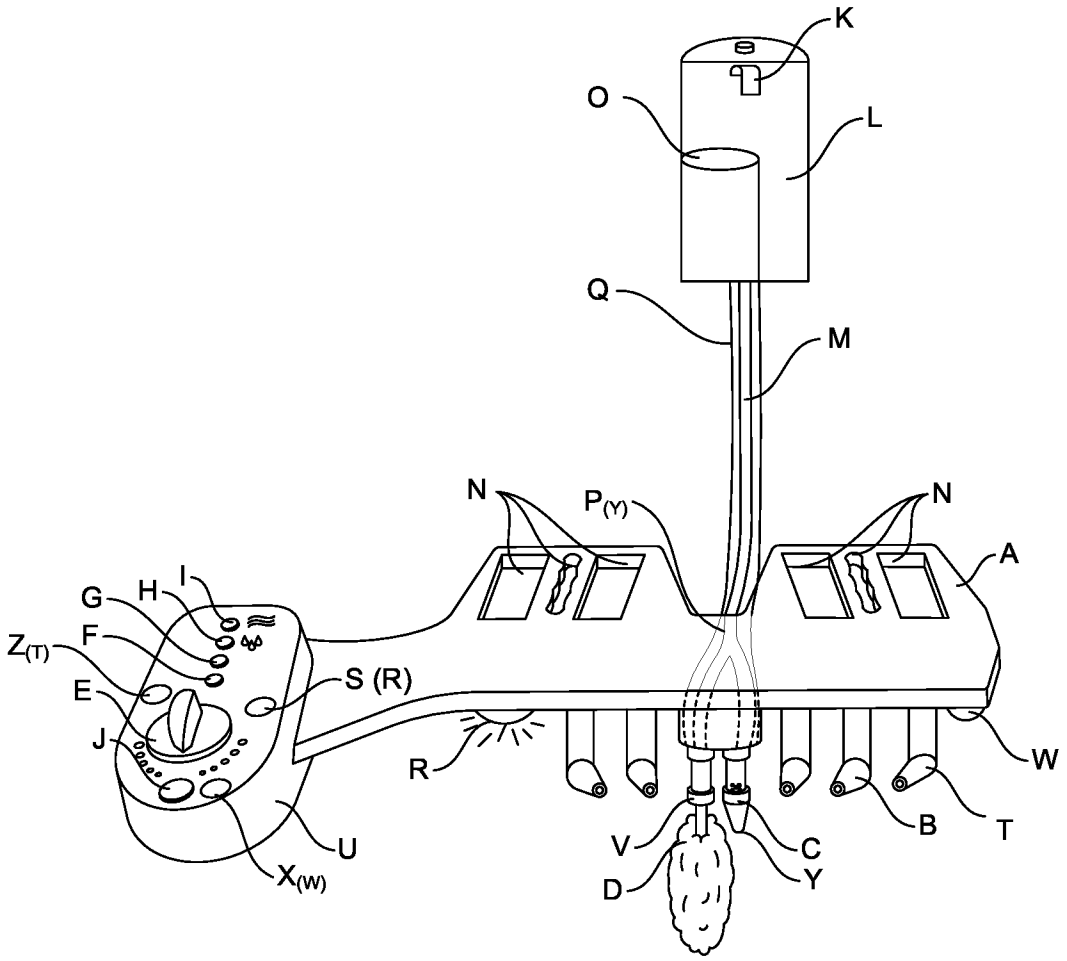
FIG. 1 is a view of the electronic bidet toilet attachment in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Throughout the present disclosure the term 'aimable' is used to refer to a component capable of being aimed at a target. The term 'rotatable' and 'tillable' refers to a piece or component which is rotated and tilted respectively.

FIG. 1 is a view of the electronic bidet toilet attachment in accordance with an embodiment of the present disclosure. The device attaches A to a toilet seat on a toilet by the mount holes N. On the bottom of the device, there are a number of components as will be explained herein. There are blow dryers B, water sprayers C, and a soft brush D. These components get their water from the toilet water tank L through the water line Q which has a smaller coaxial soap line M which receives its soap from the soap dispenser O. The plumbing "Y" joint P splits off the water and coaxial soap lines to the sprayer C and the brush D. There is an upper hook K to be mounted inside the water tank L, in which the tank O of cleaning fluid/soap is directly attached thereto. The user may control the device by means of a side panel with buttons and a dial. There are buttons to toggle the blow dryer I, to toggle the water sprayer H, to toggle the brush F, to dispense the soap G, and to flush the toilet J. There is a dial E which controls intensity. The device is powered by direct current batteries (not shown) underneath the attachment A or via a Alternating Current AC cord (not shown) to a domestic electricity supply. Also a light R supplies light via a button switch S. A perfume/cologne mister spay device T is controlled from a button switch Z on the controller panel U. Other arrangements of the foregoing components are made in embodiments according to product models and customer needs. The arrangement depicted is not intended to be limiting to the disclosed concepts and implementations. The brush D is configured with servo motors to be tilted at the joint V toward a user's discharge orifices and to rotate for a brushing cleaning motion complete with water, soap and disinfectant. The motion detector W detects when a person sits on the toilet seat and is programmable through button switch X to spray water into the toilet via the downward aimed sprayer Y and thus aid those who are susceptible to urinating with the sound of water.

Figure 2:
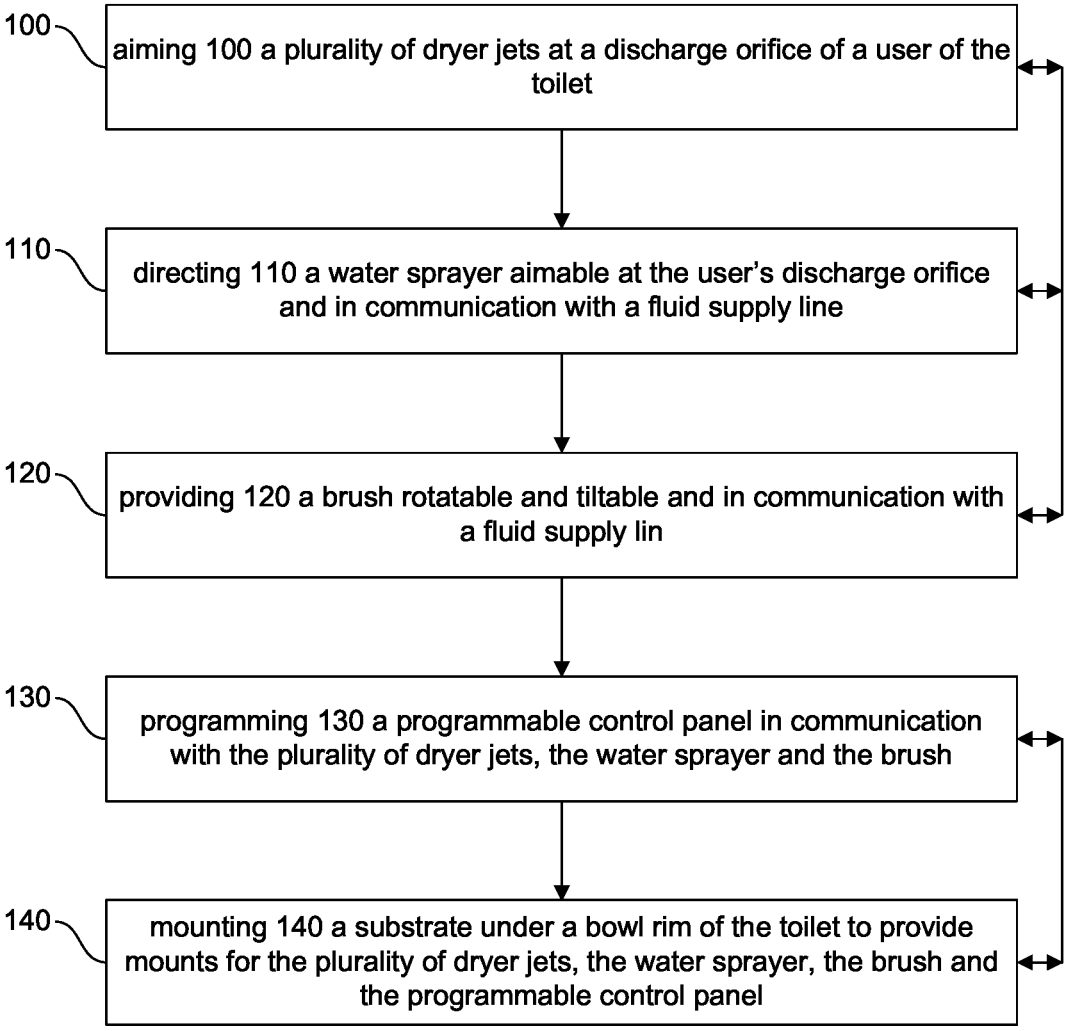
FIG. 2 depicts a method for washing in place a user of a toilet in accordance with an embodiment of the present disclosure.

FIG. 2 depicts a method for washing in place a user of a toilet in accordance with an embodiment of the present disclosure. The method includes aiming 100 a plurality of dryer jets at a discharge orifice of the user. The method includes directing 110 a water sprayer aimable at the user's discharge orifice and in communication with a fluid supply line. The method also includes providing 120 a brush rotatable and tiltable and in communication with a fluid supply line. The method additionally includes programming 130 a programmable control panel in communication with the plurality of dryer jets, the water sprayer and the brush. The method further includes mounting 140 a substrate under a bowl rim of the toilet to provide mounts for the plurality of dryer jets, the water sprayer, the brush and the programmable control panel.

Figure 3:
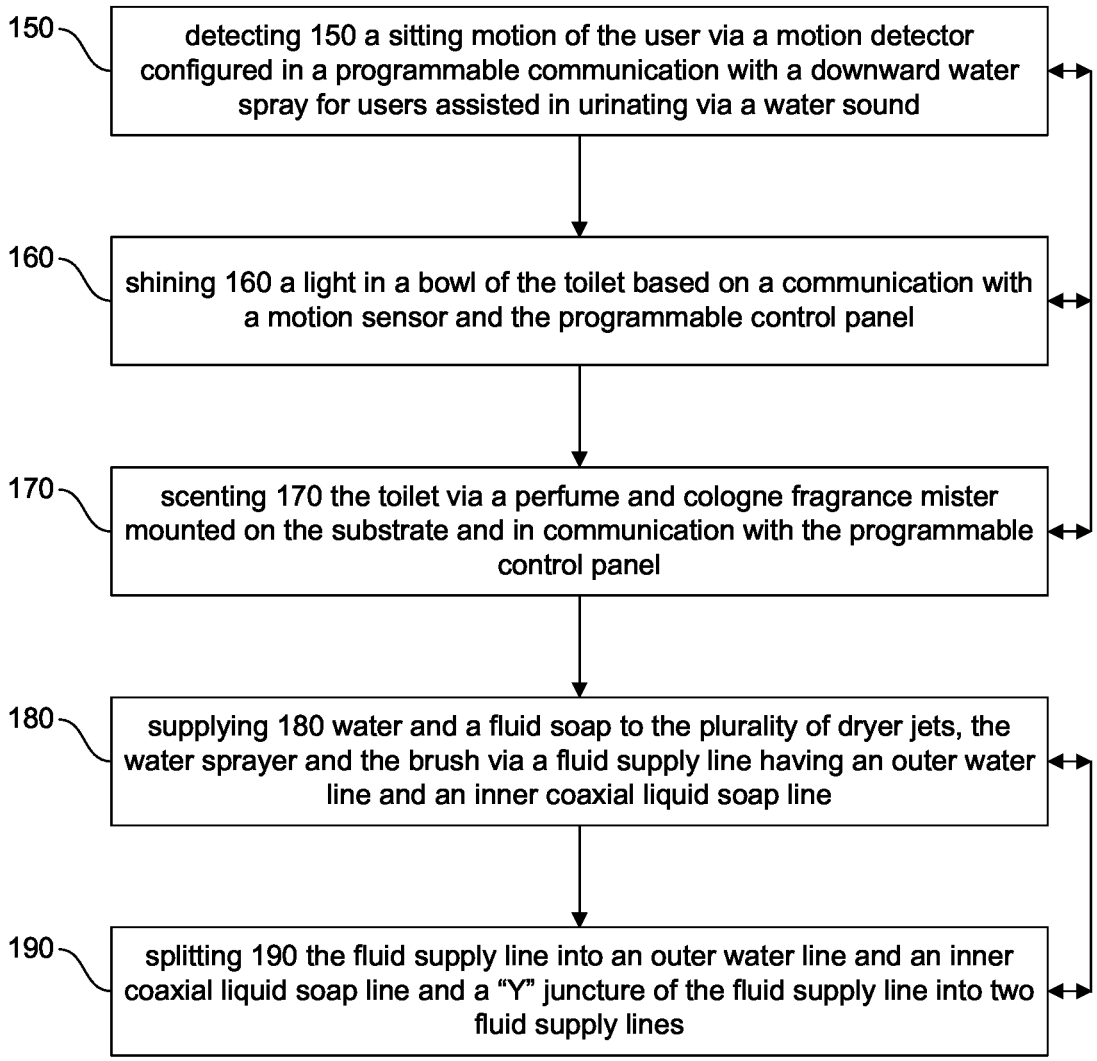
FIG. 3 depicts further methods for washing in place a user of a toilet in accordance with an embodiment of the present disclosure.

FIG. 3 depicts further methods for washing in place a user of a toilet in accordance with an embodiment of the present disclosure. Embodiments of the method include detecting 150 a sitting motion of the user via a motion detector configured in a programmable communication with a downward water spray for users assisted in urinating via a water sound. The embodied methods also include shining 160 a light in a bowl of the toilet based on a communication with a motion sensor and the programmable control panel. The embodied methods additionally included scenting 170 the toilet via a perfume and cologne fragrance mister mounted on the substrate and in communication with the programmable control panel. The embodied methods further include supplying 180 water and a fluid soap to the plurality of dryer jets, the water sprayer and the brush via a fluid supply line having an outer water line and an inner coaxial liquid soap line. The embodied methods yet include splitting 190 the fluid supply line into an outer water line and an inner coaxial liquid soap line and a "Y" juncture of the fluid supply line into two fluid supply lines.

Further methods of washing in place a user of a toilet include dispensing a liquid soap to the plurality of dryer jets, the water sprayer and the brush via a dispenser disposed within a water tank for the toilet, the liquid soap dispenser in fluid communication with the water sprayer and the brush. Controlling a valve configured to allow a liquid soap into a water supply line for the water sprayer and the brush based on an action of the programmable control panel is also disclosed herein. Moreover, moving a tiltable joint and a supplemental aimable sprayer associated with the water sprayer in communication with the programmable control panel is additionally disclosed herein.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A bidet for a toilet, the bidet comprising:

a plurality of dryer jets aimable at a user's discharge orifice;

a water sprayer aimable at the user's discharge orifice and in communication with a fluid supply line;

a brush rotatable and tiltable and in communication with a fluid supply line;

a programmable control panel in communication with the plurality of dryer jets, the water sprayer and the brush; and a substrate mountable under a bowl rim of the toilet to provide mounts for the plurality of dryer jets, the water sprayer, the brush and the programmable control panel.

2. The bidet of claim 1, further comprising a motion detector configured in a programmable communication with a downward water spray for users assisted in urinating via a water sound.

3. The bidet of claim 1, further comprising a light on the substrate in communication with a motion sensor and the programmable control panel.

4. The bidet of claim 1, further comprising a perfume and cologne fragrance mister mounted on the substrate and in communication with the programmable control panel.

5. The bidet of claim 1, wherein the fluid supply line comprises an outer water line and an inner coaxial liquid soap line.

6. The bidet of claim 1, wherein the fluid supply line comprises an outer water line and an inner coaxial liquid soap line and a "Y" juncture splitting the fluid supply line into two fluid supply lines.

7. The bidet of claim 1, further comprising a liquid soap dispenser disposed within a water tank for the toilet, the liquid soap dispenser in fluid communication with the water sprayer and the brush.

8. The bidet of claim 1, further comprising a valve configured to allow a liquid soap into a water supply line for the water sprayer and the brush based on an action of the programmable control panel.

9. The bidet of claim 1, wherein the programmable control panel is in a programmable relation with the water sprayer and the plurality of dyer jets and the brush via a respective button switch therefore.

10. The bidet of claim 1, wherein the water sprayer further comprises a tiltable joint and a supplemental aimable sprayer in communication with the programmable control panel.

11. A method for washing in place a user of a toilet, the method comprising:

aiming a plurality of dryer jets at a discharge orifice of the user;

directing a water sprayer aimable at the user's discharge orifice and in communication with a fluid supply line;

providing a brush rotatable and tiltable and in communication with a fluid supply line;

programming a programmable control panel in communication with the plurality of dryer jets, the water sprayer and the brush; and mounting a substrate under a bowl rim of the toilet to provide mounts for the plurality of dryer jets, the water sprayer, the brush and the programmable control panel.

12. The method of claim 11, further comprising detecting a sitting motion of the user via a motion detector configured in a programmable communication with a downward water spray for users assisted in urinating via a water sound.

13. The method of claim 11, further comprising shining a light in a bowl of the toilet based on a communication with a motion sensor and the programmable control panel.

14. The method of claim 11, further comprising scenting the toilet via a perfume and cologne fragrance mister mounted on the substrate and in communication with the programmable control panel.

15. The method of claim 11, further comprising supplying water and a fluid soap to the plurality of dryer jets, the water sprayer and the brush via a fluid supply line having an outer water line and an inner coaxial liquid soap line.

16. The method of claim 11, further comprising splitting the fluid supply line into an outer water line and an inner coaxial liquid soap line and a "Y" juncture of the fluid supply line into two fluid supply lines.

17. The method of claim 11, further comprising dispensing a liquid soap to the plurality of dryer jets, the water sprayer and the brush via a dispenser disposed within a water tank for the toilet, the liquid soap dispenser in fluid communication with the water sprayer and the brush.

18. The method of claim 11, further comprising controlling a valve configured to allow a liquid soap into a water supply line for the water sprayer and the brush based on an action of the programmable control panel.

19. The method of claim 11, further comprising controlling the water sprayer and the plurality of dyer jets and the brush via a respective button switch on the programmable control panel.

20. The method of claim 11, further comprising moving a tiltable joint and a supplemental aimable sprayer associated with the water sprayer in communication with the programmable control panel.

* * * * *